United States Patent [19]

Hughes

[11] Patent Number: 4,798,414

[45] Date of Patent: Jan. 17, 1989

[54] PHYSIOTHERAPEUTIC CHAIR LIKE DEVICE

[76] Inventor: Vincent Hughes, 2022 18th Ave., San Francisco, Calif. 94116

[21] Appl. No.: 161,352

[22] Filed: Feb. 22, 1988

Related U.S. Application Data

[63] Continuation-in-part of Ser. No. 2,787, Jan. 13, 1987, abandoned.

[51] Int. Cl.[4] ..... A47C 7/46; A61H 7/00

[52] U.S. Cl. ..... 297/284; 5/191; 5/236 B; 128/44; 128/49; 128/58; 297/441; 297/457

[58] Field of Search ..... 297/284, 441, 457; 5/191, 236 B, 236 R, 238, 446, 447; 160/130, 166 R; 128/44, 49, 52, 57, 58

[56] References Cited

U.S. PATENT DOCUMENTS

| | | | |
|---|---|---|---|
| 280,004 | 6/1883 | Bakewell | 297/284 X |
| 673,580 | 5/1901 | Lustig | 5/236 B X |
| 1,702,991 | 2/1929 | Bechmann | 128/58 |
| 2,361,242 | 11/1944 | Rosett | 128/299 |
| 2,487,907 | 11/1949 | Turner | 297/457 |
| 2,565,019 | 8/1951 | Buchanan | 128/71 |
| 2,692,010 | 10/1954 | Christie | 297/284 |
| 2,695,017 | 11/1954 | Herrmeyer | 128/71 |
| 2,719,986 | 10/1955 | Rand | 5/348 |
| 2,786,512 | 3/1957 | Moyer . | |
| 3,273,877 | 9/1966 | Geller et al. | 297/284 |
| 3,492,049 | 1/1970 | Fletcher | 297/316 |
| 3,498,669 | 3/1970 | Tabor | 297/396 |
| 3,499,682 | 3/1970 | Orenstein | 297/456 |
| 3,501,197 | 3/1970 | Burton | 297/232 |
| 3,503,649 | 3/1970 | Johnson | 297/459 |
| 3,511,533 | 5/1970 | Drabert | 297/337 |
| 3,511,536 | 5/1970 | Suzuki | 297/440 |
| 3,511,537 | 5/1970 | Ackermann | 297/454 |
| 3,539,220 | 11/1970 | Aguilar | 297/320 |
| 3,544,161 | 12/1970 | Bryden | 297/391 |
| 3,549,201 | 12/1970 | Wolfe | 297/284 |
| 3,565,482 | 2/1971 | Blodee | 297/284 |
| 3,595,223 | 7/1971 | Castagna | 128/33 |
| 3,596,990 | 7/1971 | Gottfried et al. . | |
| 3,602,537 | 8/1971 | Kerstholt . | |
| 3,675,644 | 7/1972 | Laskowitz | 128/58 |
| 3,760,800 | 9/1973 | Staffin | 128/24.1 |
| 3,760,801 | 9/1973 | Borgeas | 128/25 R |
| 3,762,403 | 11/1973 | Raban | 128/75 |
| 3,769,969 | 11/1973 | Nezik | 128/68 |
| 3,771,518 | 11/1973 | Greissing | 128/71 |
| 3,774,598 | 11/1973 | Wilson | 128/52 |
| 3,877,750 | 4/1975 | Scholpp | 297/284 |
| 4,154,232 | 5/1979 | Fukazawa | 128/58 X |
| 4,615,336 | 10/1986 | Fijimoto | 128/57 X |

FOREIGN PATENT DOCUMENTS

| | | | |
|---|---|---|---|
| 212776 | 3/1924 | United Kingdom | 5/236 B |

*Primary Examiner*—Peter R. Brown

[57] ABSTRACT

A special chair with embodiments providing means for prevention and treatment of back disorders by both static and dynamic operational modes comprising an integral seat and back assembly composed of multiple articulating hard surfaced segments floating on and supported by a plurality of elastic tension cords, some having oval shaped cams attached thereto. The elastic tension cords are suspended in parallel and attached to transverse members which are connected to left and right chair sides all of which are assembled in an arrangement to automatically adjust contoured and proper support to the lower and middle back regions in accordance with the weight and body bulk distribution of the occupant. A motor drive arrangement and cam spool assembly are concealed within the body of the chair to activate the hard surface elongated segments of said integral seat and back assembly in an alternating translatory and articulating motion to result in passive exercise to the lower and middle back muscles and vertebrae of the occupant.

9 Claims, 10 Drawing Sheets

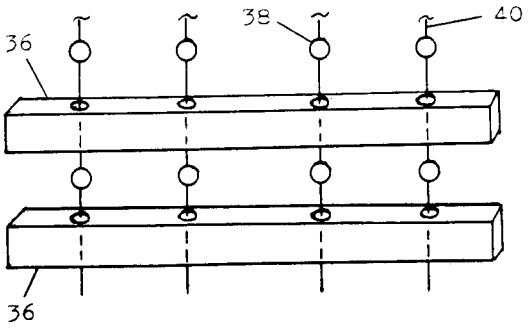
FIG 11
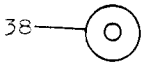
FIG 12
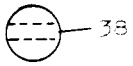
FIG 13
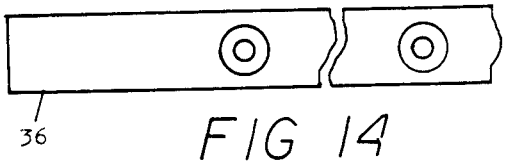
FIG 14
FIG 15
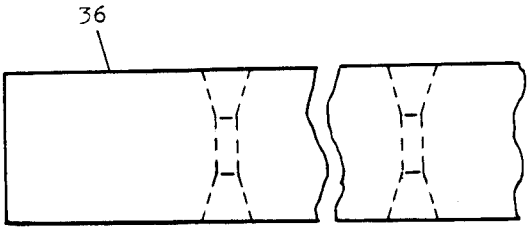
FIG 17
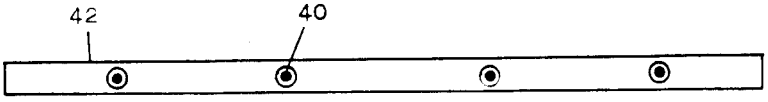
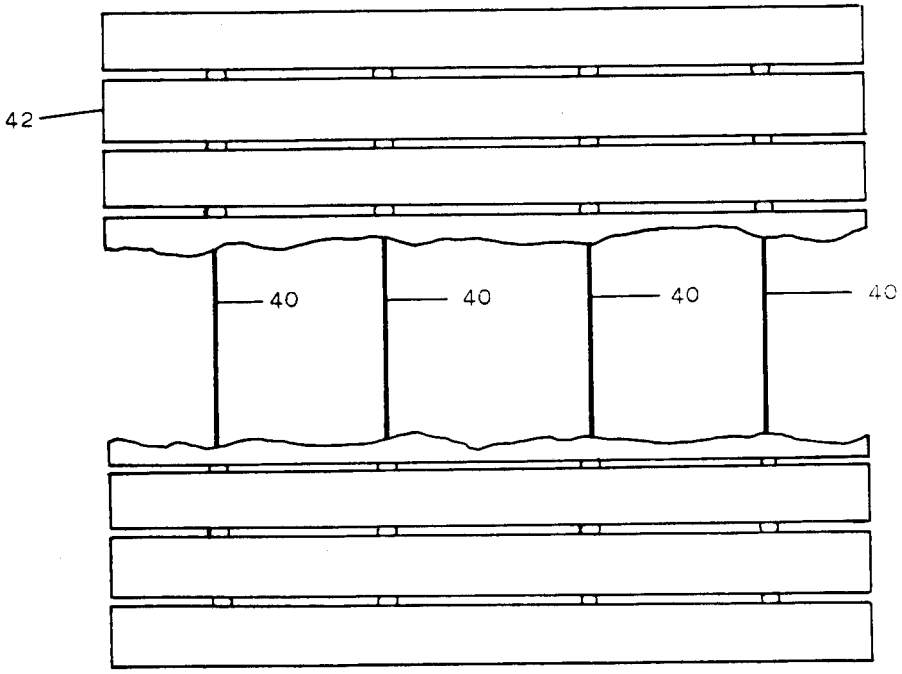
FIG 16

Section 6-6

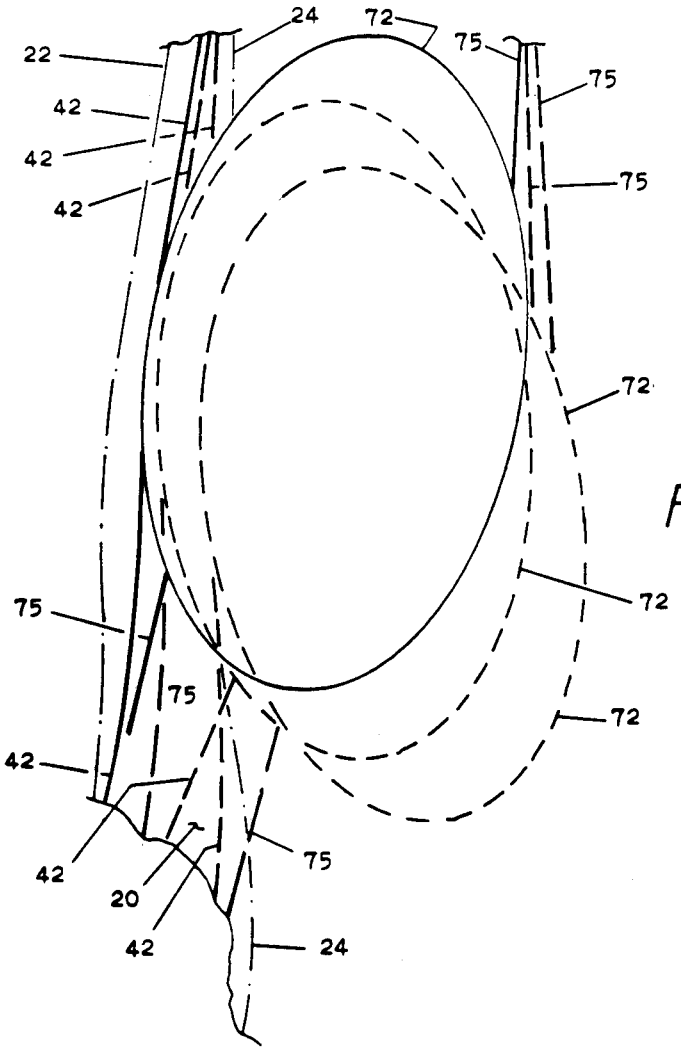
FIG 34
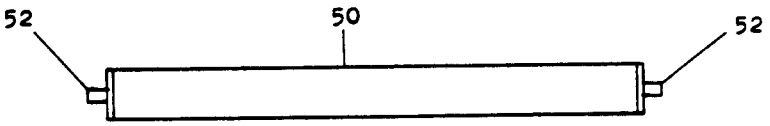
FIG 35
Item 54
FIG 36
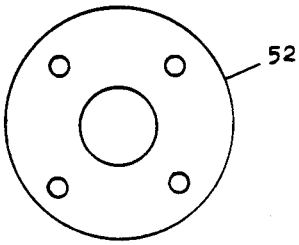
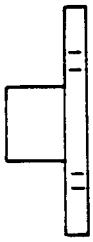
FIG 37

Section 5-5 taken off Fig. 28

PHYSIOTHERAPEUTIC CHAIR LIKE DEVICE

This is a continuation-in-part application of Ser. No. 002,787, filed Jan. 13, 1987 now abandoned.

BACKGROUND

This invention relates to a specialized article of furniture so constructed as a chair with a means to prevent back problems and for use where back disorders are treatable by physical therapy techniques in both the static and dynamic modes.

DESCRIPTION OF PRIOR ART

The human spine experiences the greatest stress in the lumbar region when the body is in the sitting position hence the most optimum posture and disposition of muscle and vertebrae become critical to prevent painful back disorders. Most all prior therapeutic devices are based on a method and means of treatment only and not on prevention and are usually of a construction that requires the occupant to be lying down, in a semi-supine position or with the lower portion of the body elevated above the head. The methods of treatment range from stretching, traction and massage, usually with the body in a horizontal position, to a fabric-type garment with fluid carrying tubes to be worn by the patient. One type of device utilizes a hollow mattress with inflation control. Here again the occupant must be lying down and the device is not a conveniently-used piece of furniture. Another device has means for applying successive blows to the various joints of the body.

Most people who are prone to having back problems would find it desirable to have an appealing piece of furniture that is actually a chair for general use but so constructed and comprising embodiments to impose a correctly-supported sitting arrangement to prevent back problems and having means to treat back disorders in a comfortable, convenient and passive way.

OBJECTS AND ADVANTAGES

Accordingly I claim as the objects and advantages of this invention the following: to provide a device with a chair-like appearance with means to furnish the occupant with flexible but firm support to the back in increments of approximately one and one-half inches so assembled and arranged to result in an automatic and continuous back embracing attitude to cause normal back disposition, curvature and support in accordance with the body weight and bulk distribution of the occupant, without prior adjustment by the occupant.

In addition, I claim the following: to provide an article of furniture comprising a motorized device to activate the unique one piece seat and back assembly support surfaces in a rhythmic, reciprocating motion resulting in passive exercise and massage-like movement of the lower and middle back muscles of the occupant, to provide a means to adjust the tension in the elastic supporting elements underlying the seat and back assembly to incline the seat to the left or right to correct lateral curvature of the back joints of the occupant.

In addition to the preferred use herein of the one-piece seat and back assembly, I claim the following objects and advantages as follows: to provide a means whereby the one-piece seat and back assembly can be directly and easily removed, rolled and transported for a multiple of other unrelated uses.

Further objects and advantages of the invention can be found from a consideration of the following description and the accompanying drawings.

DRAWING FIGURES

FIG. 11 is an exploded view of parts of the seat and back assembly with two bars and four rows of tension cords.

FIG. 12 and FIG. 13 are definitive views of the wooden bead.

FIG. 14 is a top view of the wooden bar showing the drilling and counter sinking.

FIG. 15 is an elevation view of the wooden bar showing the configuration of the drilling and counter sinking.

FIG. 16 is a view of the completed seat and back assembly with the middle group of bars removed.

FIG. 17 is a top view of the above assembly.

FIG. 34 shows sequential movement of cams against seat and back assembly.

FIG. 35 is a drawing of the roller shaft assembly, item 54.

FIG. 36 and FIG. 37 show two views of the roller shaft end piece.

FIG. 39 is a cross sectional view of cam spool upper cross member, item 73 A, showing attachment connection by slip knot of elastic cord, item 77.

DRAWING REFERENCE NUMERALS

Figure 1:
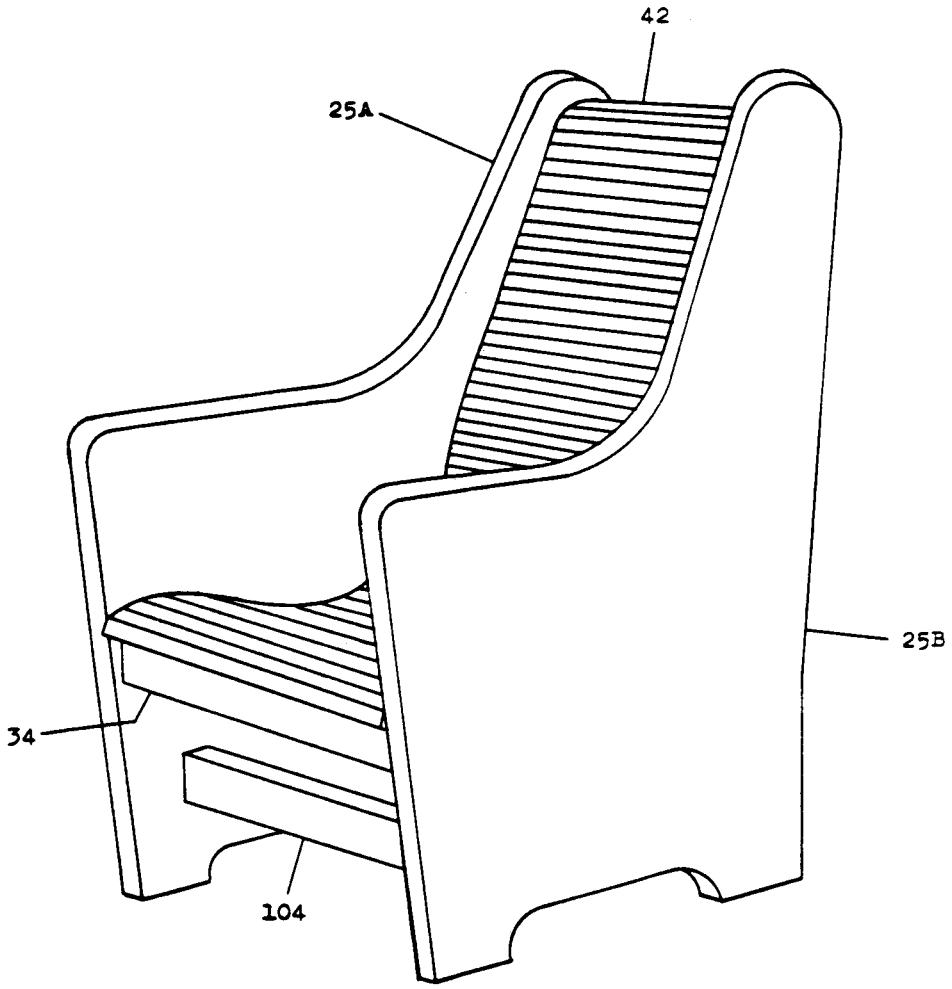
FIG. 1 shows a pictorial view of the chair.

20 Chair side
22 Chair upper inside
24 Chair lower inside
25A Chair right side assembly
25B Chair left side assembly
26 Bracket
28 Seat lip
30 Eye
32 Seat lip assembly
34 Connector
36 Bar
38 Bead
40 Elastic tension cord
42 Seat and back assembly
44 Hanger
46 Sleeve
48 Hanger assembly
50 Roller shaft
52 Shaft end
54 Roller shaft assembly
56 Ball bearing
58 Tension shaft
60 Tension shaft end piece
62 Tension shaft assembly
63 Elastic tension cord
64 Eye
66 Hex nut
68 Adjuster assembly
70 Washer
72 Cam
73A Cam spool upper transverse member
73B Cam spool lower transverse member
74 Elastic tension cord (transverse)
75 Elastic tension cord (cam laced)
76 Tension cord connector
77 Elastic tension cord joining item 39 and 73A
78 Crank shaft
79 Cam spool assembly
80 Pulley
82 Ball bearing
84 Connecting rod
86 Connecting rod upper collar
88 Connecting rod lower collar
90 Connecting rod assembly
91 Bolt
94 Back panel (not shown)
96 Gear motor
98 Pulley
100 Belt
102 Motor support
104 Connector
108 Hole in item 24 for bearing item 56
110 Slot in item 24 for tension shaft item 62
112 Hole in item 24 for bearing item 82
114 Hole in item 62 for eye item 64

DESCRIPTION-STRUCTURAL

Figure 6:
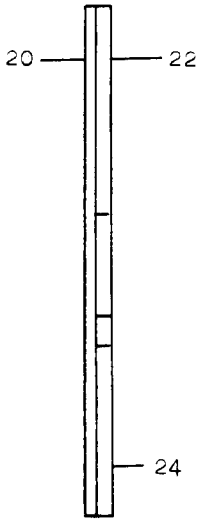
FIG. 6 is a front view of the above elevation.
Figure 5:
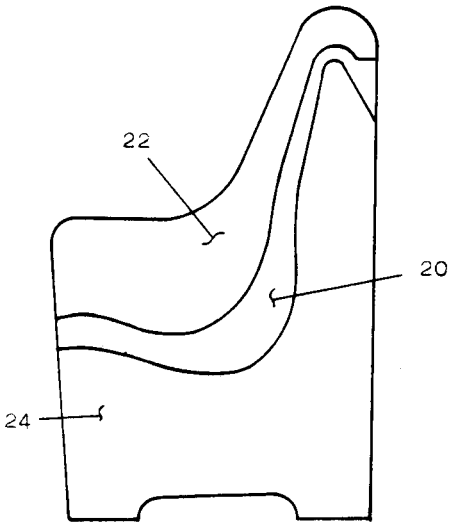
FIG. 5 is an elevation view of the right side chair assembly showing the configuration of the inside surface.
Figure 7:
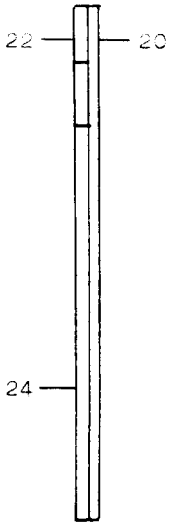
FIG. 7 is a rear view of the above elevation.
Figure 2:
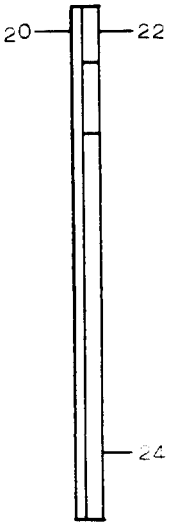
FIG. 2 is an elevation view of the left side chair assembly showing the configuration of the inside surface.
Figure 3:
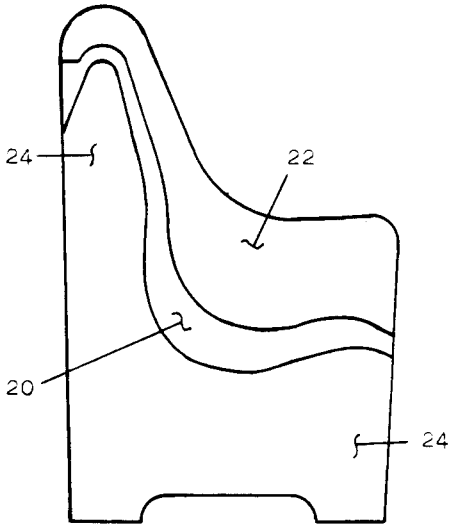
FIG. 3 is a rear view of the above elevation.
Figure 4:
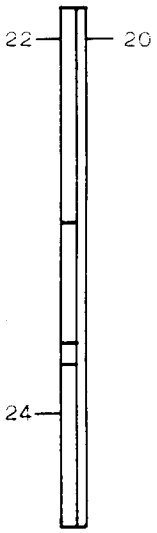
FIG. 4 is the front view of the above elevation.
Figure 8:
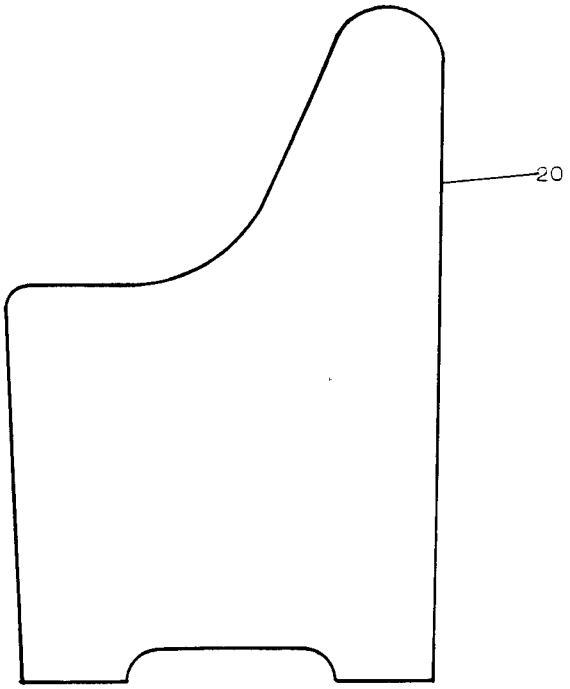
FIG. 8 is an elevation view of the exterior structural side.
Figure 9:
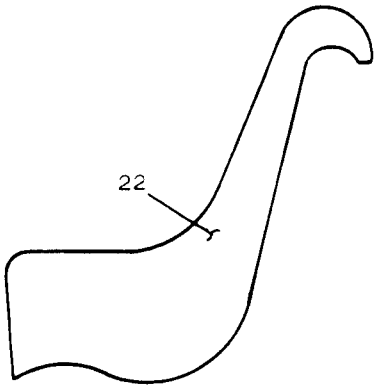
FIG. 9 shows the configuration of the upper inside chair surface.
Figure 10:
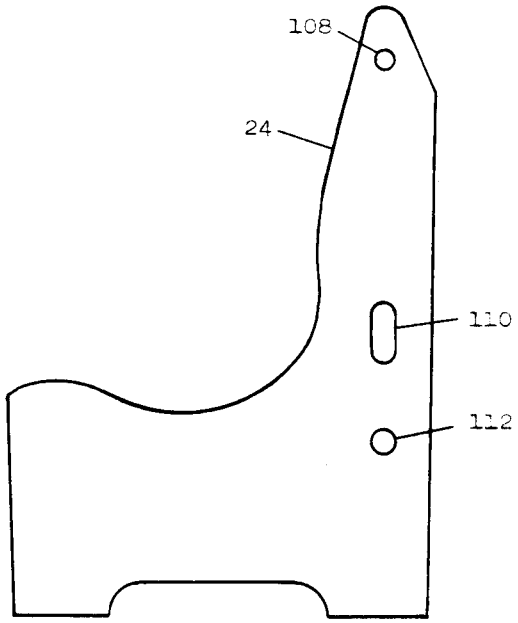
FIG. 10 shows the configuration of the lower inside chair surface.

FIG. 1 shows a pictorial view of the chair comprising left and right structural side assemblies plus a one-piece seat and back assembly. FIG. 2 shows the inside surface configuration of the left structural side assembly while FIG. 3 shows the back view and FIG. 4 shows the front view of the assembly. FIGS. 5, 6 and 7 are similar views respectively of the right structural side assembly, FIG. 8 is a view of the surface configuration of the exterior structural side. Both left and right structural side assemblies are comprised of item 20 shown in FIG. 8, item 22 shown in FIG. 9 and item 24 shown in FIG. 10, all of which are cut from ¾ inch plywood and joined together with steel screws and glue. The structural side assemblies are held in position by transverse members items 28, 34, 44, 102 and 104 joined at their ends to the side assemblies by steel wood screws. it can be seen from a review of the foregoing Figs. that a curved channel of varying cross section is formed when the upper inner side, item 22, and the lower inner side, item 24, are joined to the exterior structural side, item 20. Thus, a limiting pathway is available for each of the ends of the bar item 36 comprising the articulated one-piece seat and back assembly item 42. The length of the bars of the seat and back assembly item 42 are longer than the separation of the inner surfaces of the left and right structural sides.

FIG. 11 is an exploded view of part of the seat and back assembly showing the sequential arrangement of its three basic parts, the bar, item 36, the bead item, 38, and the elastic tension cord, item 40. FIG. 12 and FIG. 13 show two views of the spherical bead item 38. FIG. 14 and FIG. 15 are top and front view of the bar item 36 showing the drilled hole and the machining of the conical shape at opposite ends of the hole through which the elastic tension cord item 40 passes as it alternately threads through bar, bead, bar, bead, etc. at multiple locations along the length of the bar. The diameter of the drilled holes in the bars and in the beads is such to allow sufficient clearance to prevent binding of the elastic tension cords. The conical shape or countersink at the hole ends has a diameter and depth such to allow each spherical bead to be captured in the thus-firmed void with ¾ of the diameter of the spherical bead protruding. The result being a uniform separation of the adjacent bars equal to ½ the diameter of the spherical cord.

FIG. 16 shows a front view of the completed seat and back assembly with the top three and bottom three bars only showing, there being approximately 30 bars in the assembly. FIG. 17 is a top view of the seat and back assembly.

In assembling the said seat and back assembly the wooden bars are placed in parallel and one row at a time of wooden beads are positioned between each bar and in line with the drilled and countersunk holes in the bar. A tension cord, item 40, of sufficient length with the far end tied in a slip knot is then threaded through the passage holes in the bars and beads. This procedure is followed until all rows are strung. Each unknotted end of the tension cord is then stretched to a length equal to approximately twice the original length and a slip knot is tied in the tension cord at a point where it exits the last bar in the row, thus being cradled and held in its stretched condition. The excess length of cord is removed.

The captured spherical beads restrict relative motion of the bars along their length but allow each bar to rotate about the surface of the commonly shared beads in a clockwise or counter clockwise rotation.

A plurality of tension cords, item 63, each with a modulus of elasticity to accumulate a sum total of resistance to stretching equal to approximately 100 lbs. per inch are attached to the eyes, item 30, in the seat lip, item 28, wrapped over the roller shaft, item 54, and connected to the adjustable eyes, item 64, said eyes passing through holes in the tension shaft, item 62, and having hex or thumb nuts, item 66, attached at their lower ends proving a means of adjustment, said adjustment feature providing a means to vary the tension cord, item 63, stretching to effect the transverse disposition of support to the left or right side of the seat to incline the seat to the left or right to correct lateral curvature of the occupant's back.

Figure 28:
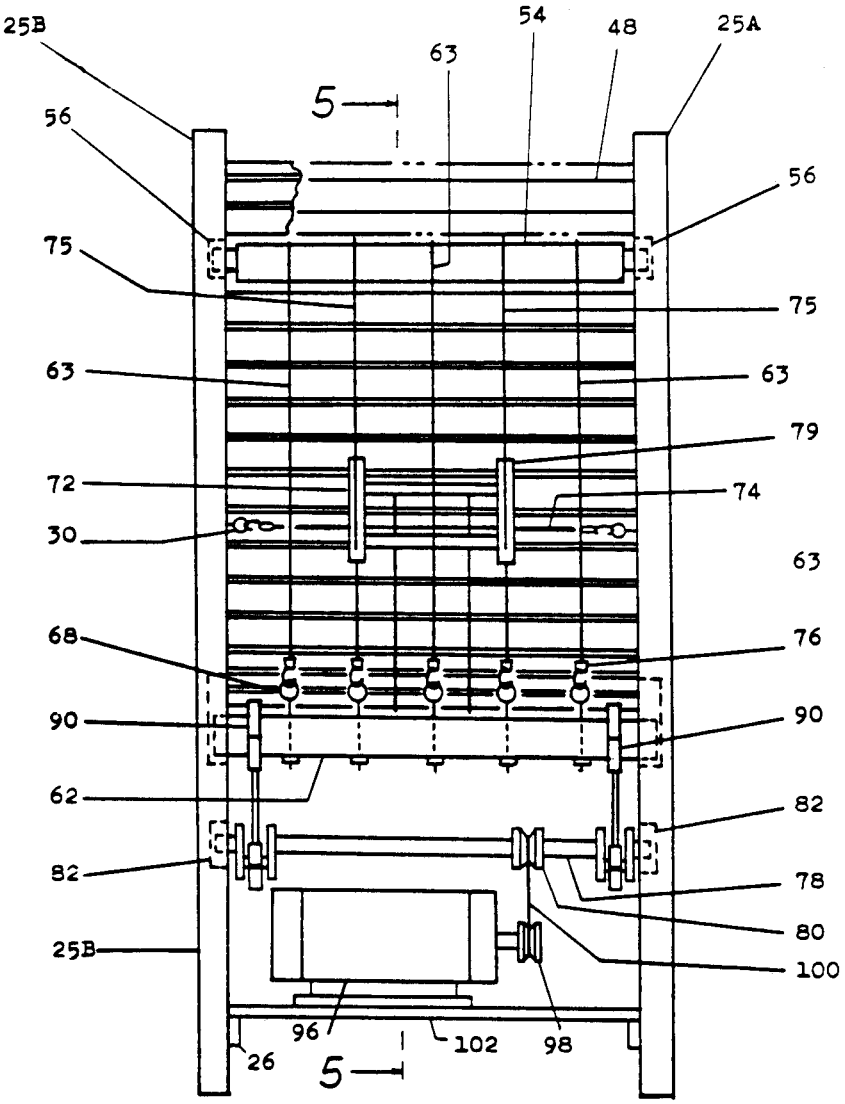
FIG. 28 is a view of the back of the chair with cover removed.
Figure 30:
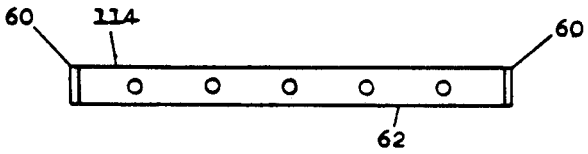
FIG. 30 and FIG. 31 are two views of the tension shaft assembly.
Figure 31:
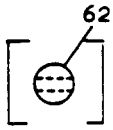
Figure 32:
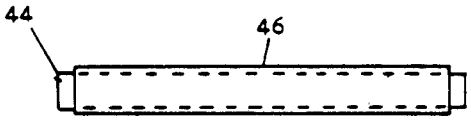
FIG. 32 and FIG. 33 are two views of the hanger assembly.
Figure 33:
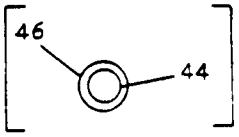

Prior to applying the seat and back assembly to the structural frame work consisting of sides, items 25A and 25B, and the transverse members, 28, 34, 44, 102, and 104, the tension shaft, item 62, roller shaft, item 54, and the crank shaft, item 78, shall have been positioned in their respective locations as shown in FIG. 28.

The completed seat and back assembly, item 42, is then placed in position by passing the ends through the upper openings in the channels in the left and right side assemblies, items 25A and 25B, with the remaining bars hanging over the sleeve of the hanger assembly, item 48, providing a means to supply additional bars of the seat and back assembly as needed to form the automatic curve shaping in accordance with the weight and body bulk distribution of the occupant simultaneously maintaining the spinal arch configuration.

Figure 22:
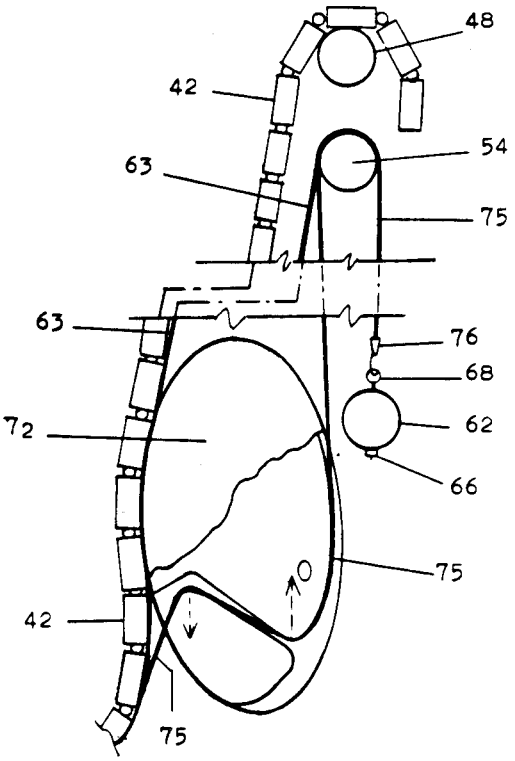
FIG. 22 is an elevation view of the cam showing a cut-away view of the internal lacing of the elastic cord 75 producing the force couple which rotates the cam against the rear of the seat and back assembly, item 42.
Figure 23:
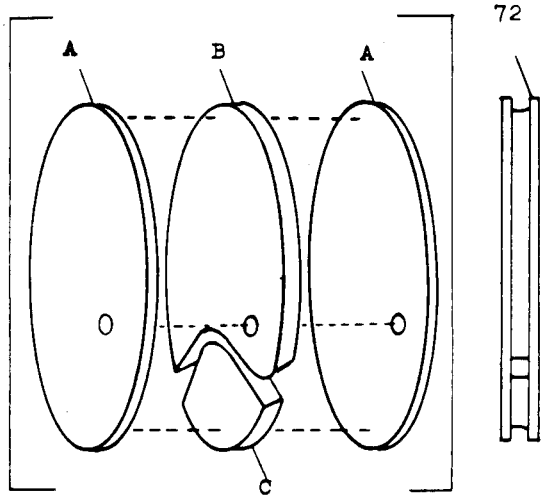
FIG. 23 is an exploded view of the cam, item 72, showing the three parts of its construction, A, B & C.
Figure 26:
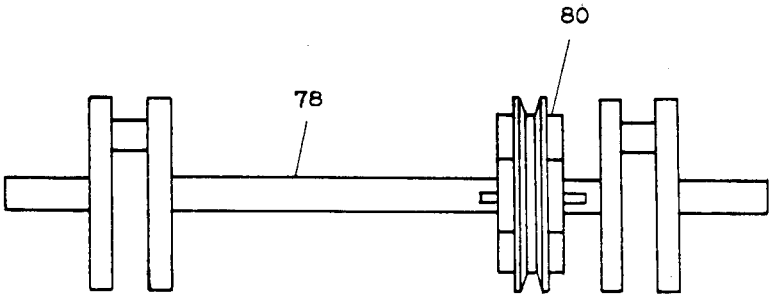
FIG. 26 is an elevation view of the crank shaft with split pulley attached.
Figure 25:
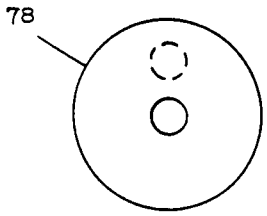
FIG. 25 is an end view of the crank shaft only.

The cams, item 72, are assembled with their respective tension cords, item 75, by lacing the said tension cord through the curved passage way in the lower portion of the cams as shown in FIG. 22, attaching end hooks, item 76, to tension cord ends, then connecting end hooks to the front seat lip, item 28, then wrapping tension cords over the roller shaft, item 54, and then downward attaching end hooks at other end of tension cords to eyes, item 64, located along and through tension shaft, item 62, as shown in FIG. 22 and FIG. 28.

ROTATION AND CURVE SHAPING BY THE CAMS

While a certain amount of curve shaping exists in the system due to the oval shape of the cams and their forced contact with the rear of the seat and back assembly by the stretching of the elastic tension cords, a rotation inward of the cams toward the rear of the seat and back assembly is accomplished by two methods.

The first method is to construct the cam with a reversing curved passage way in the lower half of the cam and thread elastic cord, item 75, through it (shown in FIG. 22). This arrangement allows a force couple to be set in place within the cam when the tension cord 75 is stretched, causing the cam to rotate inward toward the seat and back assembly when the system is activated by the weight of the occupant (shown in FIG. 22).

Figure 19:
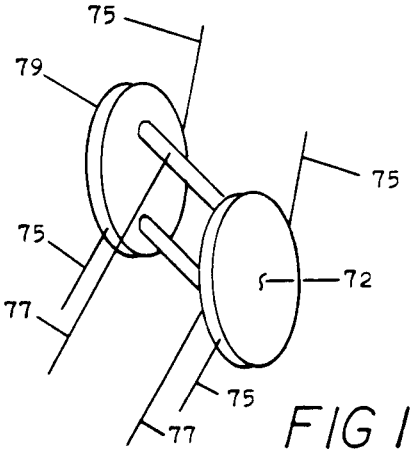
FIG. 19 is a pictorial drawing of the cam spool assembly and its suspension.
Figure 21:
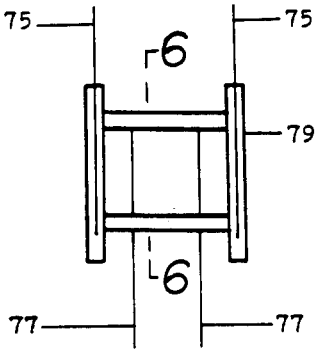
FIG. 21 is a rear view of the cam spool assembly and its suspension.
Figure 21A:
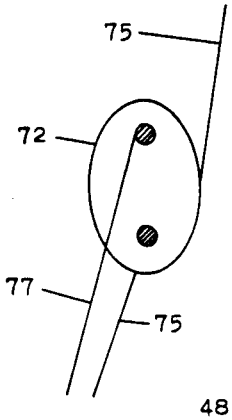
FIG. 21A is a sectional view of the cam spool assembly taken along line 6—6 on FIG. 21.
Figure 20:
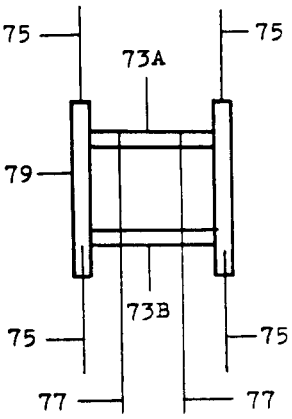
FIG. 20 is a front view (edge contacting the seat and back assembly) of cam spool assembly.
Figure 38:
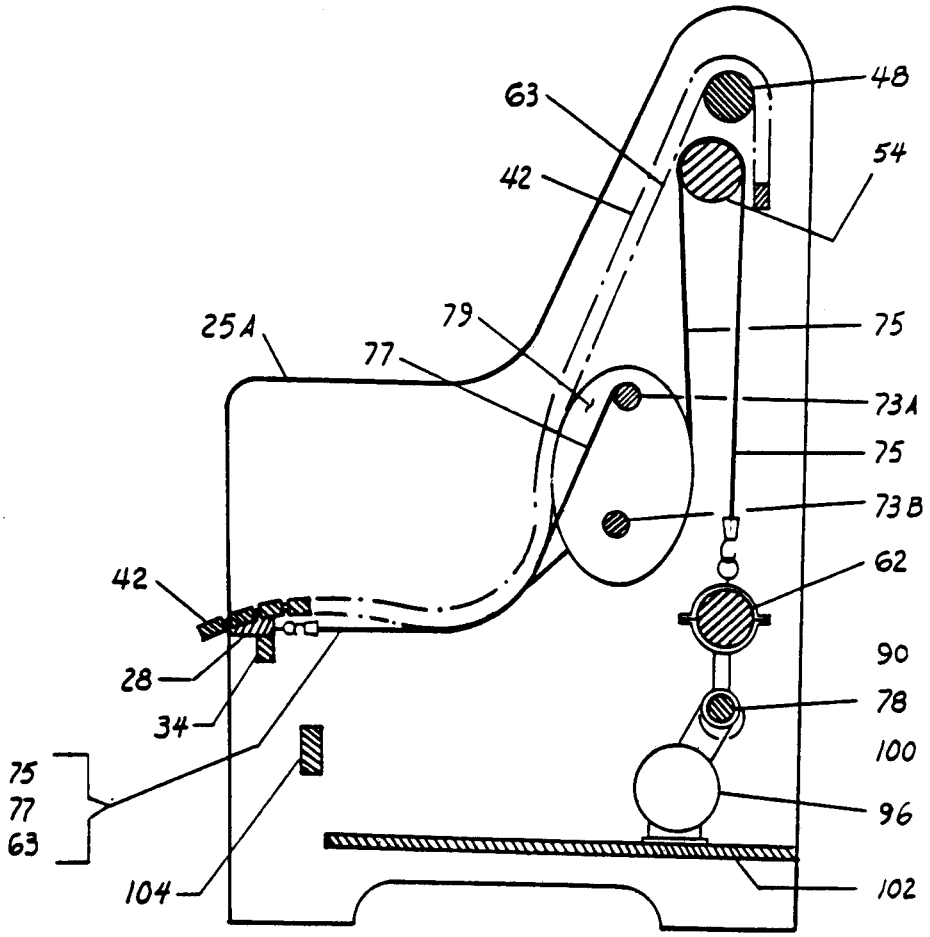
FIG. 38 is a sectional view of the chair taken along line 5—5 of FIG. 28.

The second and preferred method is to join the above-constructed cams by transverse members, items 73 A and 73 B, in parallel and connected to each cam on its major axis (shown in FIGS. 19, 20, 21, 21 A and 28) forming a cam spool assembly so that the cams act in unison. An additional external torsional moment and translation force is available to supplement the internal force couple of FIG. 22 by connecting a plurality of tension cords, item 77, between the seat lip, item 32, and the upper transverse cross member, 73 A, of the cam spool assembly (shown in FIGS. 19, 20, 21, 21 A, 28, 38, and 39). Thus the cam spool will both rotate and translate its position in accordance with the weight of the occupant (see FIG. 34 and FIG. 38).

A motor is located within the chair and below the seat, said motor, item 96, is mounted on the support, item 102, located within the chair and below the seat as shown in FIG. 28, said motor is connected to a transverse crank shaft, item 78, by a pulley, item 98, a belt, item 100, and a split pulley, time 80, said crank shaft located above the motor and having its ends journaled in ball bearings, item 82, located in left and right structural sides, said crank shaft in turn connected to the transverse tension shaft, item 62, by connecting rod assemblies, item 90, located at each end of said crank shaft, said tension shaft ends being free to reciprocate in vertical slots located in the inside surface to the left and right structural side assemblies, items 25 A and 25 B, providing a means to activate the said transverse tension shaft in a vertical reciprocating motion which in turn causes both up and down and forward and back movement of the seat and back assembly by the stretching of the array of elastic tension cords working in combination with the rotating cams to provide passive exercise to the knee joint, hip joints, pelvic area, back joints and shoulders.

DESCRIPTION-OPERATION, STATIC MODE

The fifteen basic embodiments of this invention are as follows:

1. The channeled structural side assemblies, items 25 A and 25 B.
2. The spinal arch-like curves of the above channel sides, items 22 and 24.
3. The suspended elastic tension cord array supporting the one-piece seat and back assembly.
4. The freely floating seat and back assembly, item 42.
5. The bar-conical void-bead conical void-bar joint of the seat and back assembly.
6. The elastic tension cords, item 40, used to string the barbead-bar seat and back assembly.
7. The oval shaped cams, item 72.
8. The reverse passage way in the lower portion of the cams.
9. The unique lacing of the tension cord, item 75, through the cams to cause a torsional moment to rotate the cams against the rear of the seat and back assembly.
10. The cam spool assembly formed by joining the cams together by transverse members, items 72 A and 73 B, providing a means for the cams to act in unison.
11. The elastic tension cords, item 77, connected between the seat lip and the upper transverse member, item 73 A, of the cam spool assembly providing external rotation and translation forces and movement to the cam spool assembly to curve shape the seat and back assembly.
12. The reserve portion of the seat and back assembly hung over the hanger shaft, item 48, supplying more bars as needed to form the curve shaping function.
13. The threaded eyes, item 64, through the holes in the tension shaft with hex nuts or thumb nuts attached to adjust in the array of supporting tension cords, item 63, to incline the seat portion to the left or right to correct lateral back sway.
14. The motor and drive linkage, items 78, 80, 90, 96, 98 and 100, to provide movement to the seat and back assembly for passive exercise of occupant's joints.
15. The pivot hole in the cam to transfer rotation about cam centroid to rotation about pivot and transverse tension cord, item 74, for use in the passive exercise function.

The one piece seat and back assembly, item 42, is so constructed as shown in FIGS. 11 through 17 in which a plurality of wooden bars are each drilled through and countersunk at both ends of said drilled hole. Said drilled holes and countersinking are made at multiple locations. evenly spaced along the shorter side of wooden bars. The resulting conical shaped voids provide pockets whereby a plurality of spherical wooden beads are embraded and captured by being strung alternately with the wooden bars on elastic tension cords running perpendicular to the said bars lying parallel with each other. The said tension cords being stretched to approximately twice the initial length and secured by slip knots cradled in the ultimate bars conical voids hold the elements of the assembly in contact at all times.

Thus, a unique assembly is formed resulting in a hinge type relationship between adjacent bars allowing each bar to rotate about a axis through the spherical beads said axis running perpendicular to said elastic tension cords and midway between each adjacent bar. Such an arrangement allows the assembly of rigid wooden bars to be formed into a plurality of single curved surfaces in increments of the individual bars widths.

Figure 18:
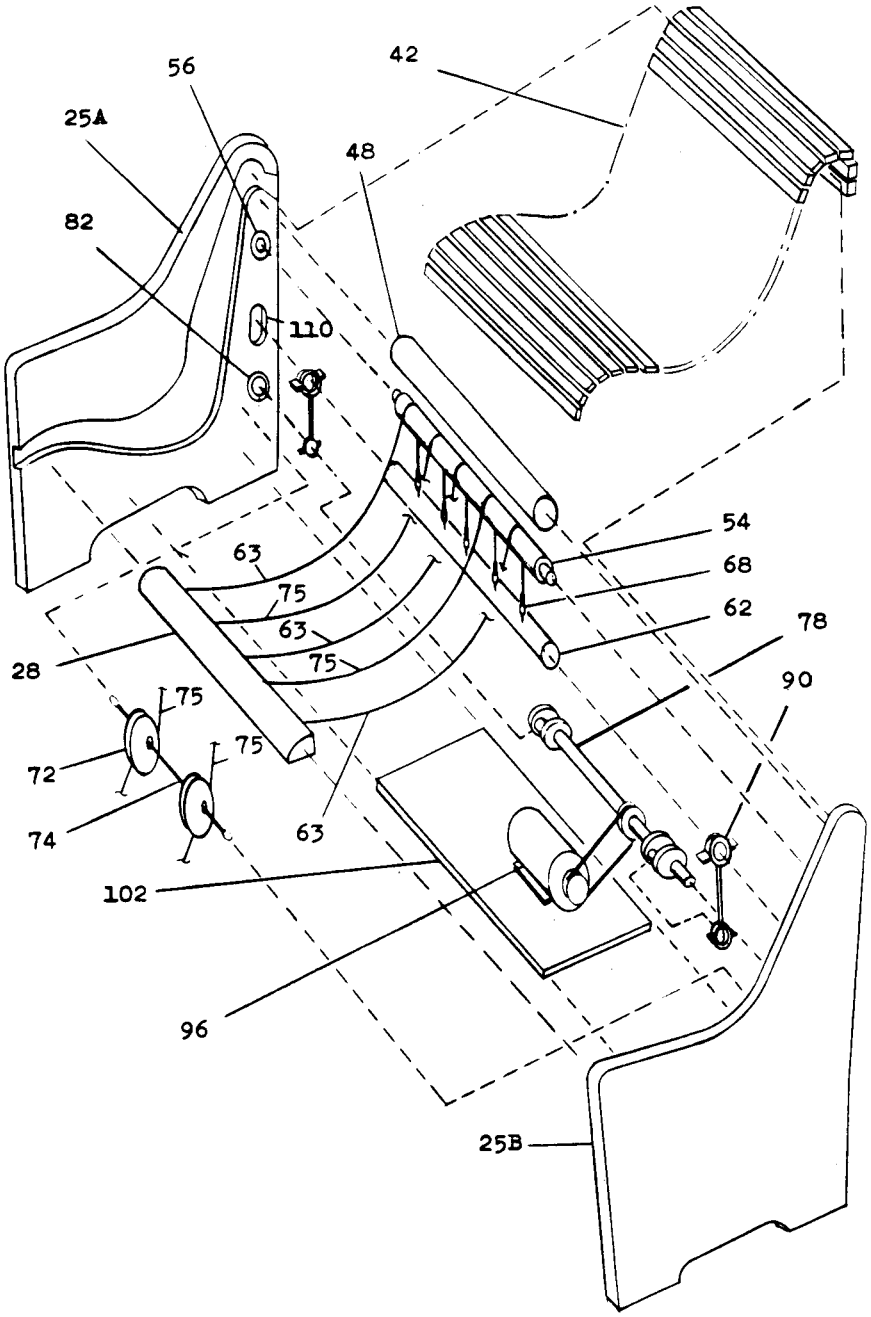
FIG. 18 is an exploded view of the chair showing the major components, with cam laced construction only.

The said seat and back assembly, item 42, is supported and freely floats on the suspended elastic tension cord assemblies, item 62, as shown in the exploded view of FIG. 18. The length of the wooden bars of the said assembly are greater than the separation of the left and right structural sides, item 25, permitting the ends of the bars to protrude an equal amount into the curved channels of the left and right sides.

The upper sides of said curved channels, item 22, have a reversing curve configuration similar to the normal spinal arch to which the flexible seat and back assembly is forced to conform by the supporting elastic tension cords, item 63. This condition prevails when the chair is unoccupied.

When the occupant initially applies his body into the seat, three actions within the device take place. The upper portion of the seat and back assembly roll over the hanger assembly, item 48, supplying more bars to form a curved shape consistent with normal back spine and muscle disposition. At the same time the cam spool assembly insures additional support and curve shaping in the lumbar area of the back by rotating about its centroid while moving downward to maintain the lower back curve in accordance with the weight and body bulk disposition of the occupant. In addition and at the same time, the supporting suspended tension cords assemblies being stretching, offering further resistance causing the seat and back assembly to cling to the occupant's back resulting in a restful and firmly-supported attitude.

DESCRIPTION - OPERATION, DYNAMIC MODE

Figure 29:
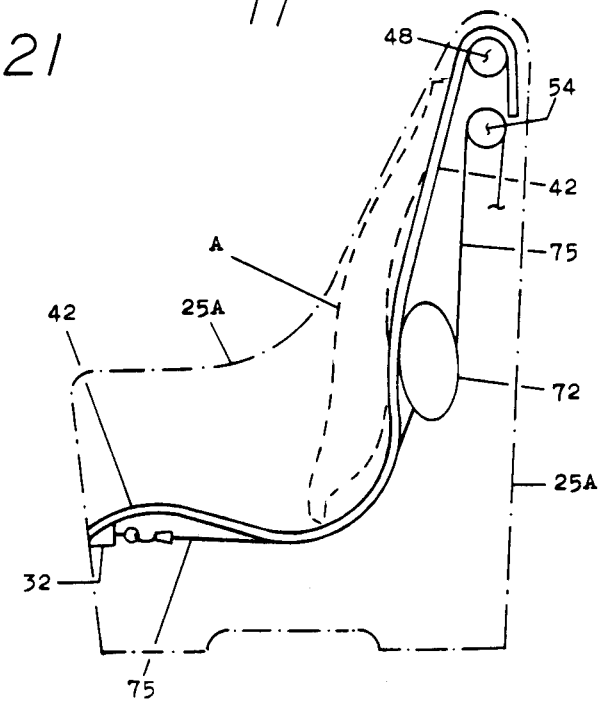
FIG. 29 is a diagram depicting the profile of the occupant's back Column "A" with the relative positions of the chair's supporting elements.
Figure 24:
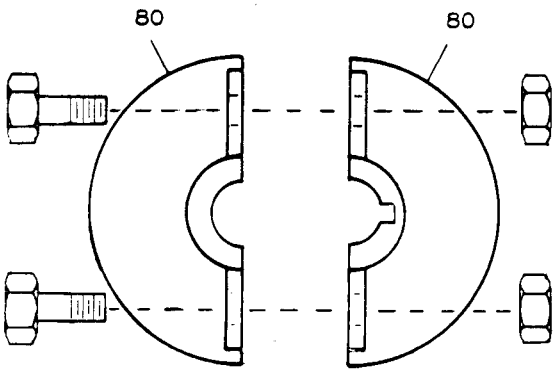
FIG. 24 is an exploded view of the split pulley assembly.
Figure 27:
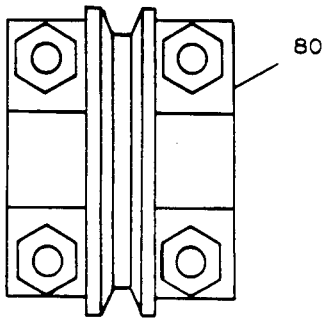
FIG. 27 is a side view of pulley assembly.

The motor drive arrangement shown in FIGS. 18 and 28 is comprised of a single phase gear motor, item 96, rated at 700 inch lbs. torque at 12 rpm, a belt drive to rotate a crank shaft, item 62, having a crank arm located near each end with connecting rods, item 90, running upward and attached to a tension shaft, item 62, said tension shaft running parallel to and vertically above the crank shaft thus converting rotary motion to a reciprocating motion. The location of the connecting rods at each end of the crank shaft and the duplicate angular orientation of the crank shaft arms, as shown in FIG. 24, insures that the tension shaft remains parallel at all times during the cycling motion. Thus, with equal sized pulleys on the motor shaft and the crank shaft and the tension shaft ends extending into the vertical slots, item 110, a reciprocating force activates the seat and back assembly through the reaction of the suspended tension as can be seen from FIGS. 18, 28, and 29. This results in the occupant's seat and back moving upward and downward every five seconds. At the same time the cams, item 72, rotate on their pivots causing the lower back bars to move forward and aft while rotating slightly, thus maintaining a profile consistent with normal back disposition, as shown in FIG. 29. This results in a passive and pleasing exercise to the occupant's knee joints, the hips, the seat and lower middle back muscles and vertebrae. The tension cord, item 74, passing through the pivot holes in the cams is to be connected by its end hooks to the eyes, item 30, on the inside of the left and right structural sides.

While the 15 basic embodiments are, as previously stated, in the above description, a 16th feature can be envisioned such as the installation of a quartz-type heater with reflector concealed within the body of the chair and located behind the lower area of the seat and back assembly to provide radiant heat through the separation of the bars of item 42.

In addition to the preferred use herein of the removable seat and back assembly, a multiple of other unrelated uses can be envisioned such as, but not restricted to, the following examples:

1. As a ground cover and support for a sleeping bag.
2. As a floor for a tent.
3. As a flexible wooden rug for beach use.
4. As a support for a table top when formed into a cylindrical shape and stood on end.
5. As a barrier fence when formed into a cylindrical shape and stood on end to contain small pets.
6. As a firm support when placed between mattress and box spring.
7. As a light weight portable raft when attached to inflatable pontoons.

While the description of the invention specifies certain materials and sizes of the components, many other variations can be envisioned, such as substitution of a plastic spherical bead like nylon or teflon for wood or the covering of the individual bars of the seat and back assembly with leather over a thin layer of foam to increase the feeling of comfort or the use of a dowel pin the length of the bar with "V" grooved bar edges as the joint configuration.

I claim:

1. A physiotherapeutic chair-like device, comprising:

(a) left and right hand structural side support assemblies being vertical and parallel and containing curved channeled passage ways on their inside surfaces, and (b) said structural side support assemblies being joined together by fixed transverse members whose ends are attached to the inside surface of the structural side support assemblies by screws or mortise and tenon joints, and (c) an array of elastic tension cords, suspended from a transverse front fixed member or seat lip, said elastic tension cords running to the rear and upward in parallel are wrapped over a transverse roller shaft whose ends are journaled in ball bearings captured in the inside surface of the said left and right structural side support assemblies then said elastic tension cords running vertically downward and attached by end hooks to threaded eyes which pass through holes in a transverse tension shaft whose ends are captured and contained in vertical slots in the inside surfaces of the said left and right structural side support assemblies, said eyes having hex nuts or thumb nuts attached to their lower ends for means to adjust the tension in the said individual tension cords of the array, and (d) a seat and back assembly composed of rigid elongated elements or bars, interconnected by means of, spherical beads and elastic elongated elements, so assembled for means of forming a plurality of articulated curved shapes, said seat and back assembly floating on and supported by said array of elastic tension cords underlying and located in the rear of the seat and back assembly, and (e) said seat and back assembly in which the length of the bars being longer than the separation of the parallel structural side support assemblies allow the edges of the seat and back assembly to protrude into and be contained by the channeled passage ways located on the inside surfaces of the left and right structural side support assemblies, and (f) a plurality of oval shaped cams located in the rear and behind the lower back area of the seat and back assembly, said cams having pulley like grooves on one edge serving as guides for elastic tension cord passage and flat surface on other edge in contact with the rear of the seat and back assembly, the said cams being maintained in contact with the rear of the seat and back assembly by the individual tension cord of the said array on which they are mounted, and (g) each said cam having a reverse curved passage way in the lower portion through which the cam mounted elastic tension cord is laced prior to attachment to the seat lip, the lacing arrangement of the elastic tension cord through the cam resulting in a force couple being set up within the cam which causes a torsional moment about the centroid of the cam rotating the cam against the rear of the seat and back assembly whereby providing a means for automatic curve shaping in the lower lumbar and part of the thorax section of the back in accordance with the weight and body bulk disposition of the occupant when the chair is used in the static mode, and (h) said cams being joined together by two transverse, parallel members located on the major axis of the oval shaped cams forming a cam spool assembly whereby providing a means for the cams to act in unison, and (i) said cam spool assembly having the ends of a plurality of elastic tension cords attached between the said upper transverse member and the seat lip whereby providing a means to supplement the automatic curve shaping by causing rotation of the cam spool assembly toward and against the rear of the seat and back assembly plus translational movement of the cam spool assembly when activated by the weight of the occupant, and (j) said cams having one or more pivot holes in which a transverse elastic tension cord passes being perpendicular to the cams and the structural side support assemblies and secured to the structural side support assemblies by end hooks attached to eyes on the inside surfaces of the side support assemblies whereby providing means for the cams to rotate about the pivot and the said transverse elastic tension cord when the chair is used in the dynamic mode, the transverse elastic tension cord being disengaged from the side supports when the chair is used in the static mode, and (k) a motor located within the chair and below the seat, said motor connected to a transverse crank shaft by a pulley and belt drive train, said crank shaft located above the motor and having its ends journaled in ball bearings located in the left and right structural sides, the crank shaft in turn connected to the said transverse tension shaft, located above the crank shaft, by connecting rod assemblies, said connecting rod assemblies located one at each end of the tension shaft, whereby providing a means to activate the tension shaft in a vertical, reciprocating motion which in turn causes up and down and forward and backward movement of the seat and back assembly by the alternate stretching and contracting of the tension cords working in combination with the rotating cams to produce passive exercise to the knee joints, hip joints, pelvic areas, back joints and shoulders.

2. A chair-like device of claim 1 in which a plurality of parallel rigid bars are joined into the seat and back assembly with multiple spherical beads and elastic elongated elements, said spherical beads and rigid bars being alternately strung on a plurality of the parallel elastic elongated elements running perpendicular to the shorter cross sectional side of the rigid bars and secured to an end bar at each end of the assembly by a slip knot in said tension cord, said knot being cradled in a conical void in the shorter cross sectional side of the end bar, all of which when completed results in a continuous, unbroken seat and back arrangement capable of being formed into multiple single curved shapes, the curved shape being in increments of the larger cross sectional side of the bar.

3. A chair-like device of claim 2 whereby the captured bead is held in conical shaped voids in adjacent bars through which the said elastic elongated elements passes, said elastic elongated elements holding bead in line contact with cone shaped void when chair is unoccupied and said bead separating slightly from cone contact due to the incremental stretching of the elastic elongated elements when the chair is being occupied increases the flexibility for curve shaping.

4. A chair-like device of claim 2 in which the elastic elongated elements in the seat and back assembly have an initial unstretched length of approximately one-half the distance between the end bars providing means to maintain linear contact between beads and cone shaped void when the chair is unoccupied and restricting relative movement of the bars in direction of their length, said bar-conical void-bar type of joint results in a hinge relationship between adjacent bars to form the articulated curve when the chair is occupied.

5. A chair-like device of claim 1 in which an array of parallel elongated elastic tension cords are suspended between the front seat lip and the roller shaft providing the immediate and main support upon which the seat and back assembly floats as it both flexes and translates its position while it is made to conform to the normal contour of the occupants's back by the action of the rotating cam spool.

6. A chair-like device of claim 1 in which said hex nuts attached to the lower ends of the threaded eyes provide means for adjusting the tension in the individual elastic tension cords, underlying the seat and back assembly, to vary the disposition of support to the left or right of the seat inclining the seat to the left or right to correct lateral curvature of occupant's spinal column.

7. A chair-like device of claim 1 in which a motor drive arrangement includes the rank shaft and connecting rods to convert rotary motion to impart reciprocating motion to the tension shaft, the location of the said connecting rods at each end of the crank shaft and the duplicate angular orientation of the crank shaft arms insures that the tension shaft remains horizontal at all times in both the static and dynamic modes.

8. A chair-like device of claim 1 in which the sides of the channeled passage ways on the inside surfaces of the left and right support assemblies have reversing curve configurations conforming to the normal spinal column arch, one side of the channel providing the initial unoccupied position while the opposite side provides the final configuration of a range of potential curved shapes to occur within the channeled passage way.

9. A chair-like device of claim 1 which the seat and back assembly is wrapped over one of the said fixed transverse members providing means for the supply of additional bars of the seat and back assembly as needed to form the automatic curve shaping function.

* * * * *